United States Patent [19]

Chang et al.

[11] Patent Number: 4,531,318

[45] Date of Patent: Jul. 30, 1985

[54] DISPLAY OR INDICATING ELEMENT WITH BENT CORE

[75] Inventors: Kwangling Chang, Toronto; Dalpat D. Mistry, Mississauga, both of Canada

[73] Assignee: NEI Canada Limited, Ontario, Canada

[21] Appl. No.: 532,771

[22] Filed: Sep. 16, 1983

[51] Int. Cl.[3] ..... G09F 9/00

[52] U.S. Cl. ..... 40/449; 40/447; 340/815.05; 340/815.27

[58] Field of Search ..... 340/815.26, 815.27, 340/815.04, 815.05; 40/449, 447, 450

[56] References Cited

U.S. PATENT DOCUMENTS

| | | | |
|---|---|---|---|
| 3,295,238 | 1/1967 | Winrow | 40/449 |
| 3,365,824 | 1/1968 | Winrow | 40/449 |
| 3,518,664 | 6/1970 | Taylor | 340/815.26 |
| 3,942,274 | 3/1976 | Winrow | 40/449 |
| 4,178,575 | 12/1979 | Ono | 340/815.04 |
| 4,243,978 | 1/1981 | Winrow | 340/815.26 |

*Primary Examiner*—Gene Mancene
*Assistant Examiner*—Cary E. Stone

[57] ABSTRACT

A thin disk contrastingly colored on opposite sides is rotatably mounted to rotate about its diameter. A permanent magnet on the disk allows the disk to be driven by a pair of reversibly magnetizable cores. One of the cores is bent to provide a stop which limits the rotation of the disk in either direction. The two limiting positions correspond to the display of the contrastingly colored sides in the viewing direction.

16 Claims, 3 Drawing Figures

DISPLAY OR INDICATING ELEMENT WITH BENT CORE

Figure 1:
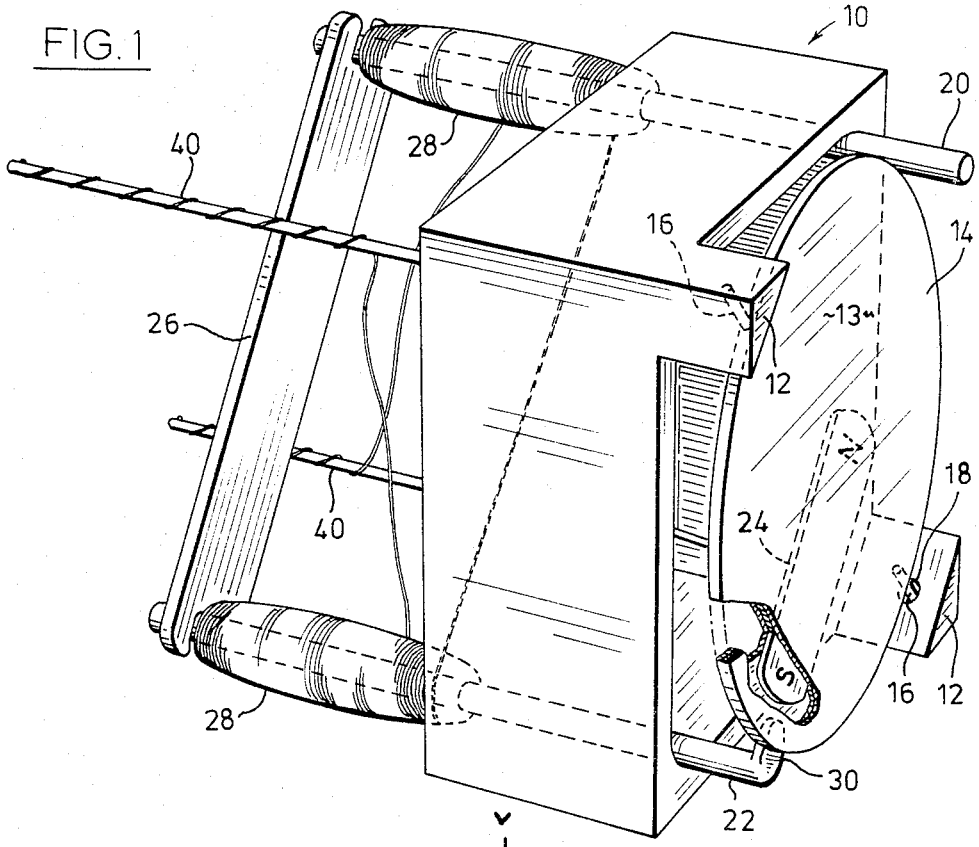

This invention relates to a novel, electromagnetically operated display or indicator element.

By the term "disk" herein we mean a relatively thin flat member which when viewed along the thickness dimension usually displays an outline approaching rotational symmetry and most commonly a circle or octagon.

By the terms "forwardly" and "rearwardly" herein we mean the directions measured from the display element toward and away from the preferred viewing location.

Elements with which the invention is concerned employ a disk, contrastingly colored on opposite sides, pivotably mounted to rotate on an axis in the median plane of the disk. The disk mounts a permanent magnet having its magnetic axis transverse to the axis of rotation. The disk is controlled by high remanence magnetic stator cores, which may be oppositely magnetized in either sense and which are arranged in one sense to bring the disk to a first quiescent position to display one side in a viewing direction and in the other sense to bring the disk to a second quiescent position to display the other side in a viewing direction.

With the type of devices with which the invention is concerned, the cores have typically been arranged to project forwardly from a housing to forward ends adjacent the locus of the permanent magnet such ends being symmetrically disposed on each side of the axis of rotation when viewed in the viewing direction. Various means have been provided to limit the rotation of the disk to less than 180° to avoid the possibility of "hang-ups" which might otherwise occur when the exterior field provided by the cores is reversed. In addition to the avoidance of hang-ups it is desirable to have a substantial starting angle between the exterior field and the permanent magnet axis in each quiescent position to increase the starting torque and thus increase the speed of switching between quiescent positions. Limitation of rotation to less than 180° is customarily achieved by mechanical or magnetic stops so that the quiescent positions are limiting positions. In addition, frequently, a stationary bias field (in addition to the reversible field provided by the cores) is provided to further increase the starting torque, as explained in U.S. Pat. No. 3,518,664, dated June 30, 1970, to M. K. Taylor.

It is an object of this invention to provide a display element as described in the previous paragraph wherein at least one of the forwardly projecting stator cores has its forward end bent toward the disk locus to enter the locus of the rotatable disk and to form the stop to limit its rotation in either direction. The bent core thus defines the quiescent or limiting positions for the disc. One side of the disk will normally be colored similarly to its background which is formed by the housing and the core members and the other side will be colored to contrast therewith. Accordingly, the limiting position with the contrasting side of the disk displayed in the viewing direction will be that with the disk overlying or forwardly of the bent core while the similarly colored side of the disk will be displayed when the disk underlies or is rearwardly of the bent core. Such designs involving the bent core tend to give better starting torques, with or without the provision of a bias stator magnet and allow arrangement using larger disks than formerly without interruption of the contour of the disk.

It is an object of a preferred aspect of the invention to provide a display element with at least one bent core as described in the previous paragraph wherein the cores projecting forwardly from the housing are spaced, as viewed in the viewing direction, on a line perpendicular to the pivotal axis of the disk and so that such line substantially crosses the widest position of the disk measured perpendicular to said viewing direction. It is found that such arrangement tends to increase the percentage of the disk area to the area required to be dedicated to such disk as seen in the viewing direction. This increase in the useful area of the display or indicator element is particularly noticeable when the disk is mounted on a housing which is square as seen in the viewing direction with the pivotal axis extending along one of the diagonals and the stator cores spaced along the other. Such arrangement also tends to produce a larger magnetic torque since the permanent magnet, with its axis aligned with the line joining the cores may be made physically longer to extend closer to the edges of what is the widest part of the disk, to make the moment arm and hence the magnetic torque greater when magnetic torque is exerted thereon.

Where a bias magnet is used its axis generally corresponds to the viewing direction and it is usually located just rearwardly of the locus of the disk and directly rearwardly of a point halfway along the rotational axis. Thus the bias magnet is relatively close to one end of the rotating permanent magnet when the disk is midway between limiting positions. At such time the bias magnet may tend to interfere with the operation of the disk by having an magnetic effect on the rotating permanent magnet far beyond its normal bias function which has its chief application when the disk is at one or the other limiting position. Better operation has therefore been achieved, where a bias magnet has been used, by off-setting the permanent magnet along its longitudinal and magnetic axis to be asymmetric relative to the pivotal axis so that the magnet is displaced toward the edge of the disk which is forward between limiting positions and away from the bias magnet between such positions.

Figure 2:
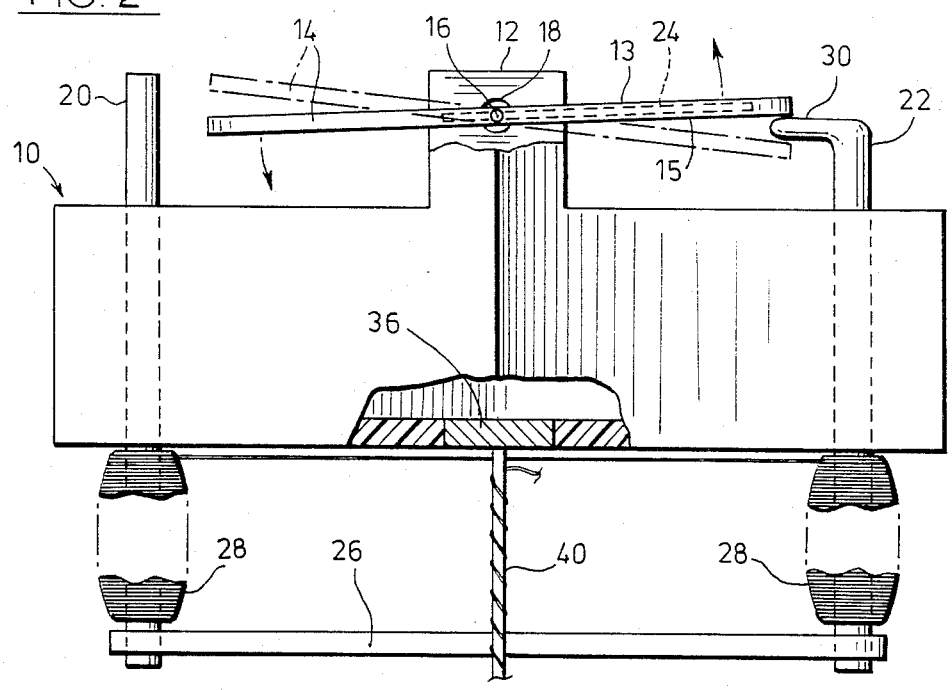
Figure 3:
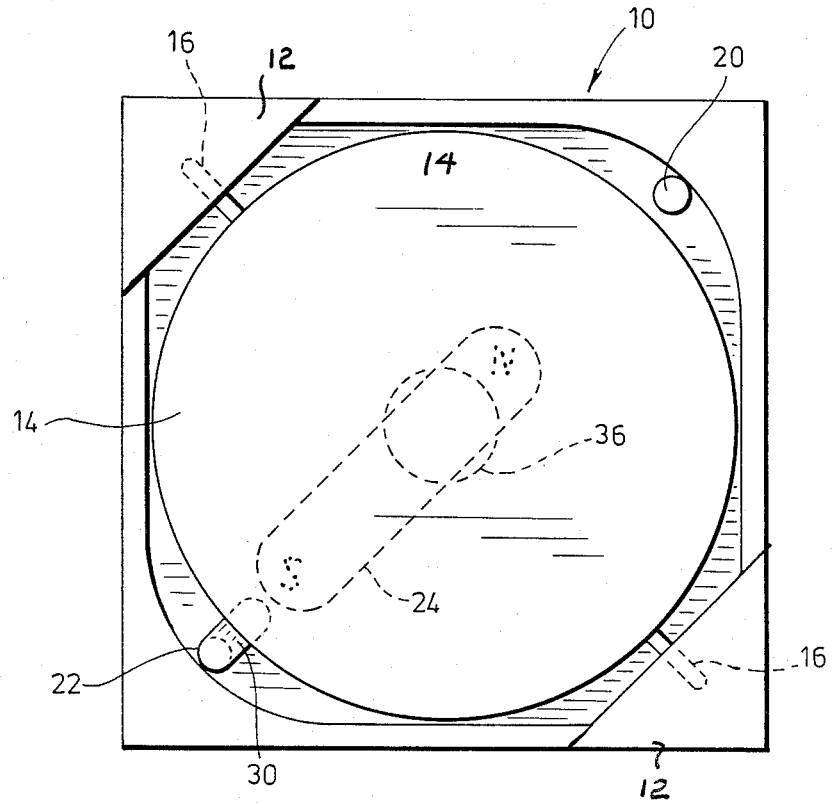

In drawings which illustrate a preferred embodiment of the invention:

FIG. 1 shows a perspective view of a device in accord with the invention; and FIG. 2 shows a side view of the device viewed along the pivotal axis, FIG. 3 shows a front view of the device.

In the drawing, FIG. 1 shows a housing 10 which is square as seen in the viewing direction V mounting a pair of forwardly projecting posts 12 at diametrically opposed corners of the square. A preferably circular thin disk 14 is provided with spindles 16 extending from the disk as extensions of the diameter thereof. Facing apertures 18 in the posts 12 are dimensioned to receive the spindles 16. Preferably the disk or the spindle is made sufficiently resilient and flexible so that it may be flexed to allow insertion of the spindles 16 into the apertures 18, after which the disk will again assume its flat shape. Although the disk is shown as circular when viewed in its thickness direction, it may equally be shaped to be octagonal, hexagonal, square etc, with the spindles extending approximately along a median line of the shape chosen. The disk is contrastingly colored on opposite sides. One side 13 will contrast with the background color of the housing and associated equipment as seen in the viewing direction. The other side 15 will be similarly colored to such stationery equipment. The disc is provided with a permanent magnet 24 having its longitudinal and magnetic axis parallel and very close to the median plane of the disk and transverse with respect to the pivotal axis. Preferably the magnet will be displaced longitudinally so as to be asymmetric with respect to the pivotal axis, as hereinafter described. Although the magnet 24 and disk 14 may be combined in a number of ways, within the scope of the invention, we prefer to construct these members with a three ply laminated disk wherein the magnet forms part of the middle layer. Such disk and its mode of construction are respectively described in U.S. Pat. No. 3,871,945, dated Mar. 18, 1975 and U.S. Pat. No. 3,953,274 dated Apr. 27, 1976. Both of these patents name as inventor Donald Winrow et al. It will also be noted that in such preferred arrangement the spindles 16 would be extensions of the middle layer made of material stiff and resilient enough to serve this purpose. The permanent magnet 24 is shown with the S pole toward tip 30 in the contrasting display position of the disk, and the north N at the opposite end. This polarity may be reversed with consequent reversal of the exterior control field to be described.

The housing 10 mounts a pair of magnetically permeable high remanence core members 20 and 22 extending generally parallel to the viewing direction which project rearwardly of the casing to mount energizing windings 28 and forwardly of the casing to forward ends which create the external field which controls, through permanent magnet 24 the orientation of the disk 14. The cores, rearwardly of the energizing windings 28 are joined into a single magnetic circuit by a bridging member 26. Energizing windings 28 are wound, connected and energized to be simultaneously pulsed to create opposite magnetic polarities at the forward ends of cores 20 and 22, i.e. if the forward end of core 20 is N, the forward end of core 22 is S and vice versa. As hereinafter described, the reversal of the opposing polarities of the forward core ends acts to rotate the disk from one of its limiting positions to the other. The cores 20 and 22 are made of high remanence magnetic material so that on pulsing of the energizing winding the opposing magnetization is created in one sense which will be retained without the presence of a pulse until an opposite pulse is provided in the windings to reverse such sense. The remanence and coercivity of the cores is selected to be high enough relative to the remanence coercivity and proximity of permanent magnet 24 that the latter does not alter the sense of magnetization of either core.

Important features of the present invention are related to the shaping, function and disposition of the cores 20 and 22. The forward-rearward extent of each core is located, as viewed, just outside of the locus of the disk edge. One core 20 is clear of such locus throughout whereas the other core 22 is bent inward at its forward end to provide a tip 30 transversely directed to the viewing direction and to the pivotal axis to interfere with the disk 14 rotation and form a mechanical stop for the disk to rotation thereof in either direction. The location of the tip 30 is disposed and dimensioned to stop the disk in either one of two limiting positions with either its contrastingly or its similarly coloured face displaced forwardly. Thus with the contrasting face displayed in the viewing direction the disk will seat on the forward side of the tip to hide it from the viewer (the solid line position of FIG. 2). With the similar face displayed in the viewing direction the disk will stop on the rearward side of the tip 30 (the dotted position of FIG. 2).

To give a better starting torque and avoid 'hang-ups', the magnetic axis of magnet 24, and hence of the disk 14 itself, is customarily angularly offset with respect to the exterior magnetic field joining the cores 20 and 22 in each of the disk's limiting positions. Such offset necessarily implies an offset of the disk 14 in either limiting position toward the other limiting position with respect to the line perpendicular to the viewing direction and the pivotal axis. Since such an offset of the disk face to the viewing direction is more easily detected when the contrasting side of the disk is forward is showing this offset is customarily made smaller. Thus the preferred offsets for a device in accord with the invention are 5° for the contrastingly colored side and 10° for the similarly colored side. This results in a rotation for the disk of $180°-(5°+10°)=165°$ between limiting positions.

Thus the tip 30 is dimensioned and located to stop the disk, rotating towards its contrasting position, with a 5° offset, as shown in FIG. 2 and rotating toward its similar position with a 10° offset, as shown in FIG. 2.

The tip 30 located below the edge of the disk in the contrasting limiting position and magnet 24 are arranged so that tip 30 is close to the nearer pole of the permanent magnet to give added starting torque when the disk is in this limiting position. This torque is increased by extending the permanent magnet 24 close to that edge of the disk which is nearest the bent core in the contrasting position. An increase of starting torque would also be obtained by extending the permanent magnet toward the opposite edge. However, as later explained, such extension toward the opposite edge can sometimes interfere with the operation of the device if a bias magnet is used. Thus the permanent magnet is often asymmetric with respect to the pivotal axis having a longer extent on the side of the disk nearer the bent core in the contrasting position than on the other side.

The torque may further be increased by using the widest portion of the disk measured perpendicular to the axis of rotation as the location for the permanent magnet 24 which may then be made longer than when it is located at other locations. Such location is of course along a diameter with the circular disk shown and along an equivalent widest portion with other shapes, which will usually be midway between the pivot spindles. Since the stator cores 20 and 22 viewed from the viewing direction align with the permanent magnet direction, the preferred position for such cores is diametrically opposed along a line through the centre of the disk and perpendicular to the pivot axis. Thus the best torque is obtained with such location of the stator cores and the permanent magnet extends to a location close to the edge of the disk in the direction toward the bent core in the contrasting position. Thus with the square housing 10 as shown the preferred arrangement is to have the pivot axis along one diameter and the cores spaced along a line coincident with the other diameter of the square, the latter line corresponding to the magnetic axis of magnet 24.

As previously explained it is frequently desirable to increase the starting torque by the provision of a stationary bias magnet 36 located on the housing, rearwardly of the centre of the disk and providing a field in the viewing direction, nearly perpendicular to the mean direction of the field created by the stator cores. The use of such bias magnet is more fully explained in U.S. Pat. No. 3,518,664 which issued June 30, 1970 to Ferranti-Packard Limited. The bias magnet 36 has a magnetic axis in the viewing direction and is designed to produce, in combination with the reversible stator fields, two resultant fields where the smaller (<180°) angle between the fields is measured in the direction of disc movement from one limiting position to the other. The use of such bias magnet 36 with the resultant fields causes the disk to assume limiting positions where the disk magnet aligns with the relevant resultant field as closely as the mechanical stop (in this case provided by bent tip 30 will allow) and provides a larger starting torque varying as the amount that the angle between the disk magnet in one limiting position and the resultant field to provide the other limiting position, differs from 180°.

It will be noted that the bias magnet 36, located rearwardly of the centre of the disk will have its maximum individual effect on the disk when the plane of the disk is parallel to the viewing direction since the then rearward pole of the permanent magnet will then be closest to the bias magnet 36. To avoid unwanted interaction the permanent magnet 24 and the bias magnet 36, the permanent magnet is displaced farther from the edge of the disk which will be rearward during disk movement between limiting positions.

The bent tip 30 of the core 22 is directed toward the other core 20 and transversely relative to the viewing direction. The effect of such transverse direction is to increase the magnetic torque from the contrast position partially because of the inward displacement of the tip 30 and partially from the transverse direction of the flux field from tip 30 and to increase the magnetic torque starting from the similar position mainly due to such transverse direction of the flux.

Posts 40 extend rearwardly from the housing and provide mounting means for the housing as well as electrical terminals for the windings. Windings 28 are electrically connected in series between posts 40 and the sense of windings 28 is of course such that an electrical potential in one and the other sense across posts 40 will cause one and the other sense of opposing magnetic polarity in the forward end of cores 20 and 22.

In operation with the device in the solid line position of FIG. 2 tip 30 will be a north pole to attract the S(south) pole of magnet 24 and the forward end of core 20 will be a south pole to attract the N(north) pole of magnet 24. Due to the high remanence cores the disk will remain in such position without energization in windings 28. When windings 28 are pulsed to reverse the opposing polarities of tip 30 and the forward end of core 20, (to south and north respectively), each end of magnet 24 is subjected to magnetic torque causing rotation of the magnet 24, and with it disk 14 counter clockwise in FIG. 2 to the dotted limiting position. The disk will continue to the dotted position of FIG. 2 after the cessation of the pulse and remain there until windings 28 are again energized. When windings 28 are again pulsed to again reverse the opposing core polarities the disk will rotate clockwise in FIG. 2 from the dotted to the solid line position.

We claim:

1. Electromagnetically operated display or indicator element comprising:

a relatively thin disk defining a median plane and of contrastingly colored on opposite sides;

a housing rotatably mounting the disk for rotation about an axis adjacent and approximately parallel to said median plane, the outline of said disk when viewed along its thickness dimension being approximately symmetrical about said axis of rotation, a permanent magnet mounted on the body of and to rotate with said disk and defining a longitudinal and a magnetic axis both transverse with respect to said pivotal axis, and both generally parallel to the plane of said disk, a pair of high remanence magnetic cores mounted on said housing and defining free ends located adjacent the edges of said disk when said disk is displaying either of its contrasting sides in the viewing direction, at least one of said cores being bent adjacent its free end to define a tip extending transverse to the viewing direction and located to act as a stop for said disc on rotation in either direction theretowards whereby said bent core defines a first limiting position for rotation of said disk with said disk overlying said bent tip and displaying one side in the viewing direction and a second limiting position for rotation of said disk with said disk underlying said bent tip and displaying the other side in the viewing direction, said cores being arranged relative to the locus of said permanent magnet so that with said free ends oppositely magnetized in one sense, said disk will be rotated from the first to the second limiting position; and with said free ends oppositely magnetized in the other sense, said disk will be rotated from the second to the first limiting position, means for selectively magnetizing said cores in one of said opposing senses.

2. Electromagnetically operated display or indicator element as claimed in claim 1 wherein said cores, excluding the bent tip on said one core, project in the viewing direction from said housing and, when viewed in the viewing direction, define between them a line substantially perpendicular to the rotational axis.

3. Electromagnetically operated display or indicator element as claimed in claim 2 wherein said cores are so located and said disc is so shaped when viewed in the thickness direction that the line joining said cores is substantially perpendicular to said pivotal axis and crosses the disk at substantially its widest dimension measured perpendicular to said pivotal axis.

4. Electromagnetically operated display or indicator element as claimed in claim 3 wherein said magnetic axis is substantially aligned with the line joining said cores.

5. Electromagnetically operated display or indicator element as claimed in claim 3 wherein said housing is generally square as viewed in the viewing direction, said rotation axis is directed generally along a diagonal of said square and said cores excepting said at least one tip are generally spaced along the other diagonal of said square.

6. Electromagnetically operated display or indicator element as claimed in claim 4 wherein said housing is generally square as viewed in the viewing direction, said rotation axis is directed generally along a diagonal of said square and said cores excepting said at least one tip are spaced approximately along the other diagonal of said square.

7. Electromagnetically operated display or indicator element as claimed in claim 2 wherein said magnetic axis is substantially aligned with the line joining said cores.

8. Electromagnetically operated display or indicator element as claimed in claim 7 wherein said housing is generally square as viewed in the viewing direction, said rotation axis is directed generally along a diagonal of said square and said cores excepting said at least one tip are spaced approximately along the other diagonal of said square.

9. Electromagnetically operated display or indicator element as claimed in claim 2 wherein said housing is generally square as viewed in the viewing direction, said rotation axis is directed generally along a diagonal of said square and said cores excepting said at least one tip are generally spaced along the other diagonal of said square.

10. Electromagnetically operated display or indicator element as claimed in claim 1 wherein said magnetic axis is substantially aligned with the line joining said cores.

11. Electromagnetically operated display or indicator element as claimed in claim 10 wherein said housing is generally square as viewed in the viewing direction, said rotation axis is directed generally along a diagonal of said square and said cores excepting said at least one tip are generally spaced along the other diagonal of said square.

12. Electromagnetically operated display or indicator element as claimed in claim 1 wherein said housing is generally square as viewed in the viewing direction, said rotation axis is directed generally along a diagonal of said square and said cores are generally spaced along the other diagonal of said square.

13. Electromagnetically operated display or indicator element as claimed in claim 12 wherein the side of said displayed in the viewing direction in the second limiting position is colored similarly to that part of said housing visible in the viewing direction.

14. Electromagnetically operated display or indicator element as claimed in claim 12 wherein said magnet extends longitudinally along said magnetic axis and is offset longitudinally relative to the pivotal axis to be nearer said bent core when said disk overlies said bent core and wherein a second permanent magnet is mounted on said housing located rearwardly of the centre of said disk and said second permanent magnet defines a magnetic axis approximately corresponding to said viewing direction.

15. Electromagnetically operated display or indicator element as claimed in claim 1 wherein the side of said disk displayed in the viewing direction in the second limiting position is colored similarly to that part of said housing visible in the viewing direction.

16. Electromagnetically operated display or indicator element as claimed in claim 1 wherein said magnet extends longitudinally along said magnetic axis and is offset longitudinally relative to the pivotal axis to be nearer said bent core when said disk overlies said bent core and wherein a second permanent magnet is mounted on said housing located rearwardly of the centre of said disk and said second permanent magnet defines a magnetic axis approximately corresponding to said viewing direction.

* * * * *